US010610023B2

(12) United States Patent
Daur et al.

(10) Patent No.: US 10,610,023 B2
(45) Date of Patent: Apr. 7, 2020

(54) CONNECTION ASSEMBLY FOR A BACKREST AND OFFICE OR CONFERENCE CHAIR

(71) Applicant: Sedus Stoll AG, Waldshut (DE)

(72) Inventors: Judith Daur, Waldshut (DE); Thomas Stenzel, Brunnadern (DE); Harry Fischer, Degernau (DE); Kurt Buntru, Eberfingen (DE)

(73) Assignee: Sedus Stoll AG, Waldshut (DE)

( * ) Notice: Subject to any disclaimer, the term of this patent is extended or adjusted under 35 U.S.C. 154(b) by 0 days.

(21) Appl. No.: 16/101,577

(22) Filed: Aug. 13, 2018

(65) Prior Publication Data

US 2019/0053626 A1 Feb. 21, 2019

(30) Foreign Application Priority Data

Aug. 16, 2017 (DE) ..... 10 2017 214 298

(51) Int. Cl.

| | |
|---|---|
| ***A47C 3/00*** | (2006.01) |
| ***A47C 7/44*** | (2006.01) |
| ***A47C 7/48*** | (2006.01) |
| ***A47C 1/032*** | (2006.01) |

(52) U.S. Cl.

CPC ..... *A47C 7/448* (2013.01); *A47C 1/03255* (2013.01); *A47C 7/48* (2013.01)

(58) Field of Classification Search

CPC ..... A47C 1/03255; A47C 7/48; A47C 7/448; A47C 7/44; A47C 7/46; A47C 1/03272

USPC ..... 297/291, 284.1, 284.4, 284.7, 293, 285

See application file for complete search history.

(56) References Cited

U.S. PATENT DOCUMENTS

| | | | | |
|---|---|---|---|---|
| 6,698,833 | B2 * | 3/2004 | Ball | A47C 1/023 297/284.4 |
| 8,696,064 | B2 * | 4/2014 | Pan | A47C 7/443 297/284.4 |
| 9,578,968 | B2 * | 2/2017 | Masunaga | A47C 7/462 |
| 2003/0001420 | A1 * | 1/2003 | Koepke | A47C 1/03255 297/440.15 |
| 2008/0012412 | A1 * | 1/2008 | Piretti | A47C 1/03233 297/341 |

(Continued)

FOREIGN PATENT DOCUMENTS

| | | |
|---|---|---|
| DE | 10048779 A1 | 4/2002 |
| JP | H02125664 | 10/1990 |

(Continued)

OTHER PUBLICATIONS

European Search Report corresponding to European application No. 18185480.3, dated Aug. 31, 2018 (8 pages).

*Primary Examiner* — Chi Q Nguyen
(74) *Attorney, Agent, or Firm* — Maginot, Moore & Beck, LLP

(57) ABSTRACT

A connection assembly for a backrest, of an office or conference chair, includes a backrest structural element, a transverse support element, a transverse bearing by means of which the backrest structural element is rotatably coupled to the transverse support element in a direction perpendicular to a transverse direction, and a connection portion connecting the transverse support element to the backrest structural element, arranged and formed so that the backrest structural element is resiliently movable relative to the transverse support element.

16 Claims, 3 Drawing Sheets

(56) References Cited

U.S. PATENT DOCUMENTS

| | | | | |
|---|---|---|---|---|
| 2008/0231095 | A1* | 9/2008 | Brauning | A47C 7/38 297/219.1 |
| 2010/0148554 | A1* | 6/2010 | Yang | A47C 7/405 297/291 |
| 2011/0298260 | A1* | 12/2011 | Hsuan-Chin | A47C 7/402 297/284.7 |
| 2012/0161483 | A1* | 6/2012 | Hayashi | A47C 1/03238 297/300.2 |
| 2013/0082499 | A1* | 4/2013 | Schmitz | A47C 1/03255 297/285 |
| 2015/0272334 | A1* | 10/2015 | Gloeckl | A47C 7/443 297/284.7 |
| 2016/0143443 | A1* | 5/2016 | Roslund, Jr. | A47C 7/44 297/299 |

FOREIGN PATENT DOCUMENTS

| | | |
|---|---|---|
| JP | H03130720 | 12/1991 |
| KR | 101691859 | 1/2017 |

* cited by examiner

CONNECTION ASSEMBLY FOR A BACKREST AND OFFICE OR CONFERENCE CHAIR

This application claims priority under 35 U.S.C. § 119 to patent application no. DE 102017214298.7, filed on Aug. 16, 2017 in Germany, the disclosure of which is incorporated herein by reference in its entirety.

FIELD OF THE INVENTION

The present invention relates to a connection assembly for a backrest, in particular for an office or conference chair. The present invention further relates to an office or conference chair having such a connection assembly.

BACKGROUND ART

Movable mountings for office chair elements exist in a wide variety of embodiments. Elastomer bearings, which may be formed as a metal/elastomer composite component, for example, are inter alia used to connect a backrest to a chair frame.

Backrests connected by such bearings are also referred to as dorsokinetic backrests. Accordingly, the bearings themselves are sometimes referred to as dorsokinetically flexible joints. Such a backrest particularly distinguishes itself in that it at least partially supports rotary motions, sideways motions and motions of the back.

An elastomer bearing for a dorsokinetic backrest is described in printed matter DE 10 2012 214642 A1, for example. According to this, a base plate, a counterflange and an elastomer body fixedly connected to the base plate and the counterflange as well as a collar sleeve attached to the base plate and at least sectionally enveloping the elastomer body and the counterflange are provided.

SUMMARY OF THE INVENTION

Against this background, the present invention is based on the object to provide an improved movable connection assembly for a backrest.

According to the invention, this object is achieved by

- a connection assembly for a backrest, particularly of an office or conference chair or an office or conference seating furniture, such as an office swivel chair, comprising a structural element of the backrest, a transverse support element, a transverse bearing by means of which the backrest structural element is rotatably coupled to the transverse support element in a direction perpendicular to a transverse direction, a connection portion connecting the transverse support element to the backrest structural element and being arranged and formed so that the backrest structural element is resiliently movable relative to the transverse support element; and
- an office or conference chair or an office or conference seating furniture, such as an office swivel chair, comprising a backrest and armrests coupled to a seat support, and a connection assembly according to the invention, wherein the seat support is coupled to the transverse support element and the backrest structural element forms a supporting portion of the backrest.

In particular, a connection assembly for a backrest of an office or conference chair is provided. The connection assembly comprises a transverse support element, a backrest structural element, a connection portion connecting the transverse support element to the backrest structural element and being formed so that the backrest structural element is resiliently movable relative to the transverse support element, and a transverse bearing by means of which the backrest structural element is rotatably coupled to the transverse support element in a direction perpendicular to a transverse direction.

Furthermore, an office or conference chair is provided. The office or conference chair comprises a seat support, a backrest and a connection assembly according to the invention. Here, the seat support is coupled to the transverse support element and the backrest structural element forms a supporting portion of the backrest.

An idea, on which the present invention is based, is to resiliently connect a transverse support element to a backrest structural element by a connection portion directly molded thereon or directly connected thereto and, at the same time, to rotatably couple the backrest structural element to the transverse support element. For example, the connection of the connection portion with the transverse support element and the backrest structural element may be formed as a fixed connection, e.g. a material-fit connection. In principle, one or more spring elements may additionally or alternatively be provided to achieve the desired effect. The resilient effect of the connection portion may be adjusted by both the selection of material and the structural design. Thus, the backrest is not only movable in the sagittal plane. Rather, a complex interaction of tilting and rotary movements is facilitated to provide the user with the most natural freedom of movement possible. For example, a user may laterally or transversely lean against the backrest and twist it laterally backwards relative to the transverse support element and ultimately to the seat body (i.e., around an axis of rotation perpendicular to the transverse support element), thereby "pulling along" the transverse support element as it were due to the coupling. Here, the connection portion simultaneously acts as return member. Hence, an ergonomically advantageous mobility, preferably a dorsokinetic mobility, of a backrest is provided, the manufacture of which is very simple. Connecting the backrest in accordance with the invention provides a significant improvement in mobility compared to conventional solutions. Therefore, the transverse support element, for example, may directly be formed or rather molded as armrest support, thereby achieving that the armrest support is also coupled to the movement of the backrest.

Such a connection assembly may be manufactured, for example, by first molding the transverse support element and the backrest structural element, e.g. in an injection molding process, and then, in separate steps, forming a transverse bearing and/or molding the connection portion on the elements. In principle, the transverse bearing or subcomponents of the transverse bearing may already be molded on the transverse support element and/or the backrest structural element or rather be built in the same, e.g. by multi-component injection molding processes, during manufacture. Likewise, the connection portion or parts of it may be molded directly on the other elements during manufacture. According to the invention, an additional dorsokinetic bearing may now be dispensed with and the plurality of parts and complex manufacture thereof may be avoided, which advantageously simplifies the manufacture. Furthermore, the number of parts of an office or conference chair is also reduced for final assembly, thereby simplifying the assembly of an office or conference chair as well.

All in all, an economically and ergonomically advantageous connection assembly for a backrest is created, which realizes movability of the backrest, and in particular dorsokinetics.

Advantageous embodiments and developments arise from the further sub-claims as well as from the description with reference to the figures of the drawing.

According to a development, the transverse support element may be formed as armrest support. Hereby, it is advantageously achieved that the armrest support is directly coupled to the movement of the backrest.

The transverse support element may be formed in a fork shape having two fork arms. Each fork arm may respectively comprise one armrest. Thus, the design is very slim and the transition to the armrest is designed favorably.

According to a development, the backrest structural element may be formed as a backrest frame. Therefore, the backrest structural element advantageously forms a supporting portion of the backrest. The backrest frame may be formed circumferentially, for example. The backrest frame may be covered with a cover, particularly a mesh cover, for example. However, upholstery or the like may alternatively or additionally be provided as a matter of course.

According to a development, the transverse bearing may have a bearing pin. The bearing pin may be rotatably supported in a lower bearing bush of the transverse support element. The bearing pin may further be rotatably supported in an upper bearing bush of the backrest structural element. Here, different advantageous embodiments of the transverse bearing are conceivable. For example, the bearing pin may be non-rotatably connected to the transverse support element or be molded thereon. In this exemplary embodiment, the bearing pin may be supported in an upper bearing bush of the backrest structural element. To this end, the bearing pin may for example be inserted into the upper bearing bush during assembly. In another embodiment, the bearing pin may be appropriately connected to the backrest structural element or molded thereon. In this case, the bearing pin may be supported in a lower bearing bush of the transverse support element. In a further exemplary embodiment, the bearing pin may be formed as a separate component, which is supported in both a lower bearing bush and an upper bearing bush.

According to a development, the transverse bearing may preferably be embedded in the connection portion. This embodiment not only provides esthetic advantages. Moreover, the connection mechanism of this development may be made uniform and compact and thus be sealed off from environmental influences.

According to a development, the connection portion may have a thermoplastic elastomer, i.e. be formed as elastomeric connection portion. In particular, the connection portion may have a urethane-based thermoplastic elastomer (thermoplastic polyurethane, TPU). However, the connection portion may generally include a wide variety of elastomeric materials, e.g. based on rubber and/or other thermoplastic elastomers (TPE) or the like, and/or be molded thereof.

The connection portion may be integrally molded of the thermoplastic elastomer. Thus, the connection portion having a simple and robust design may advantageously be molded in one process step.

According to a development, the resilient properties in the connection portion are realized by adequate thinning of the material, adequate material recesses and/or different elastic properties of the material of the connection portion.

According to a development, the connection portion may have at least one spring element and/or be made of one spring element. However, in principle, the connection portion may comprise more spring elements and/or be made thereof. For example, the connection portion may provide two separate regions, each of which is disposed at different sides of the backrest structural element and connected to the transverse support element. In this way, a backrest structural element, such as a backrest frame, may be peripherally connected to a transverse support element, such as an armrest support, for example on the left and right by means of two elastic connection elements.

According to a development, the connection portion may be formed as a return spring so as to automatically reset a rotary movement of the transverse bearing around its axis of rotation by elastic force. So, the connection portion functions as return spring for an axial movement of the transverse bearing.

According to a development, the transverse support element may be molded of injection-molded plastics. For example, the transverse support element may thus be formed having an appropriate stiffness and/or strength so as to function as stiff and supporting transverse structure of the chair. In principle, such an injection-molded part may be used directly by means of its robustness. However, it may also be further reinforced and/or covered by protective layers or the like. For example, a reinforcement of aluminum may be provided so as to make the support elements at the same load more filigree and therefore more attractive, for example.

According to a development, the transverse support element is disposed at the height of a seat support of the office or conference chair. According to a further development, the transverse support element is disposed at the height of a seating surface of the office or conference chair.

According to a development, in the region of the connection portion, the transverse support element is bent upwardly towards the backrest structural element. According to an alternative development, in the region of the connection portion, the transverse support element is bent downwardly towards a base or rather swivel frame of the office or conference chair.

According to a development, the transverse support element may be formed as a part of a synchronizing mechanism of the office or conference chair. To this end, for example, an end of the transverse support element facing away from the backrest may form a link of the synchronizing mechanism.

If appropriate, the above embodiments and developments may be combined with one another as desired. Further possible embodiments, developments and implementations of the invention also include not explicitly mentioned combinations of features of the invention described above or below with reference to the embodiments. In particular, a person skilled in the art will add individual aspects to the respective basic form of the present invention as improvements or additions.

BRIEF DESCRIPTION OF THE DRAWINGS

Hereinafter, the present invention will be explained in more detail with reference to the examples of embodiments given in the schematic figures of the drawing, in which.

Figure 1:
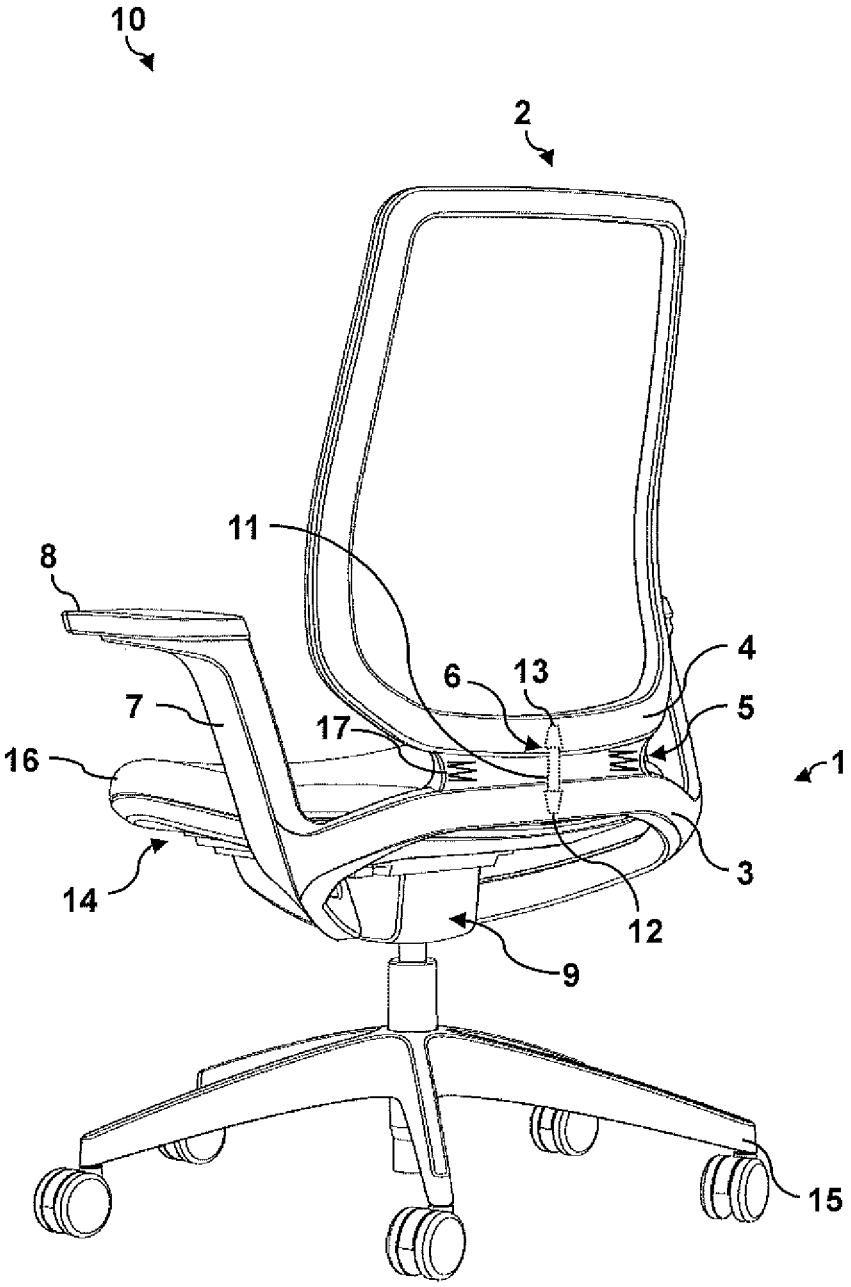
FIG. 1 is a schematic perspective view of an office chair, when viewed obliquely from the rear, including a connection assembly according to an embodiment of the invention.

The accompanying figures of the drawing are intended to provide a further understanding of the embodiments of the invention. They illustrate embodiments and serve in conjunction with the specification to explain principles and concepts of the invention. Other embodiments and many of the mentioned advantages will become apparent in view of the drawings. The elements in the drawings are not necessarily shown true to scale to each other.

Throughout the figures of the drawing, identical, functionally identical and identically acting elements, features and components are respectively designated by the same reference numerals, unless stated otherwise.

DETAILED DESCRIPTION

Figure 2:
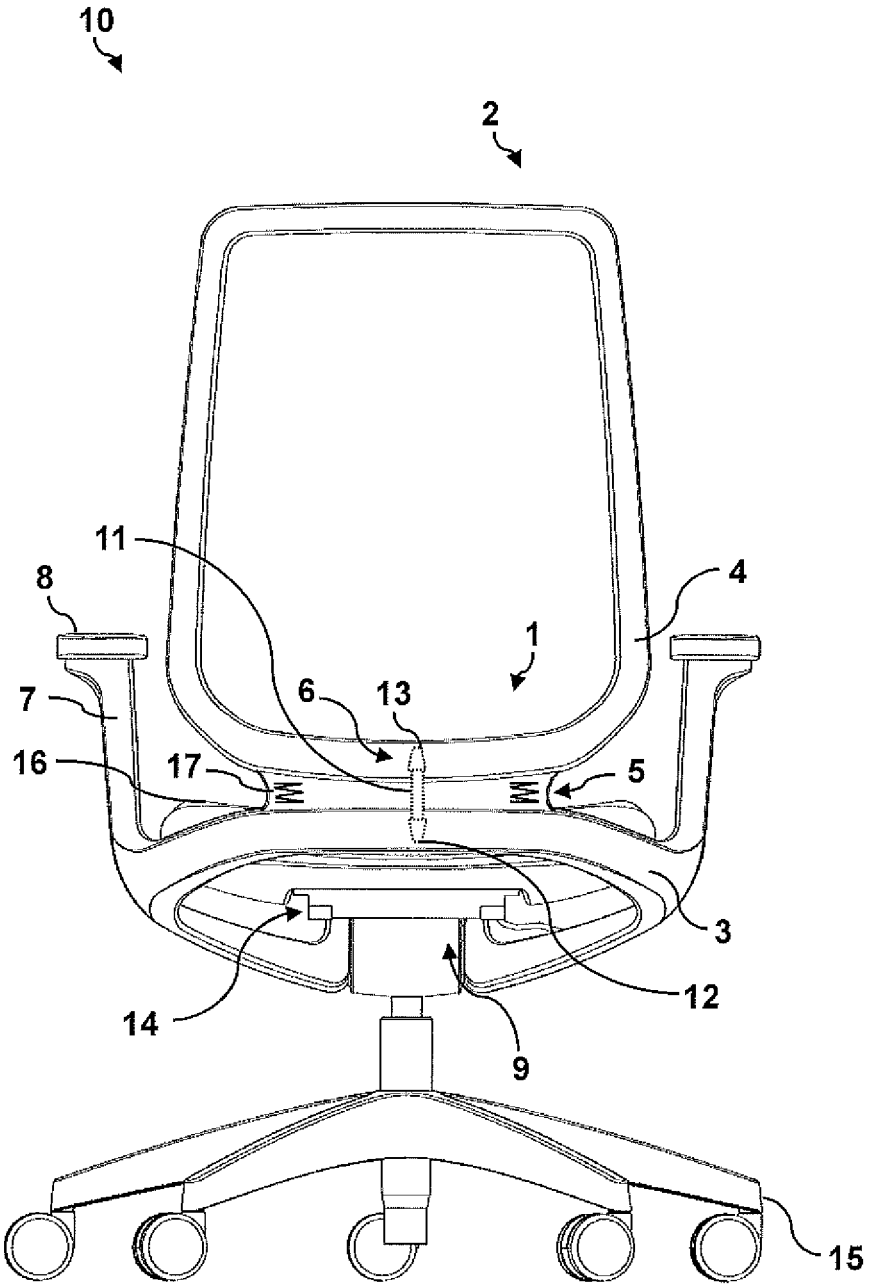
FIG. 2 is a rear view of the office chair of FIG. 1.
Figure 3:
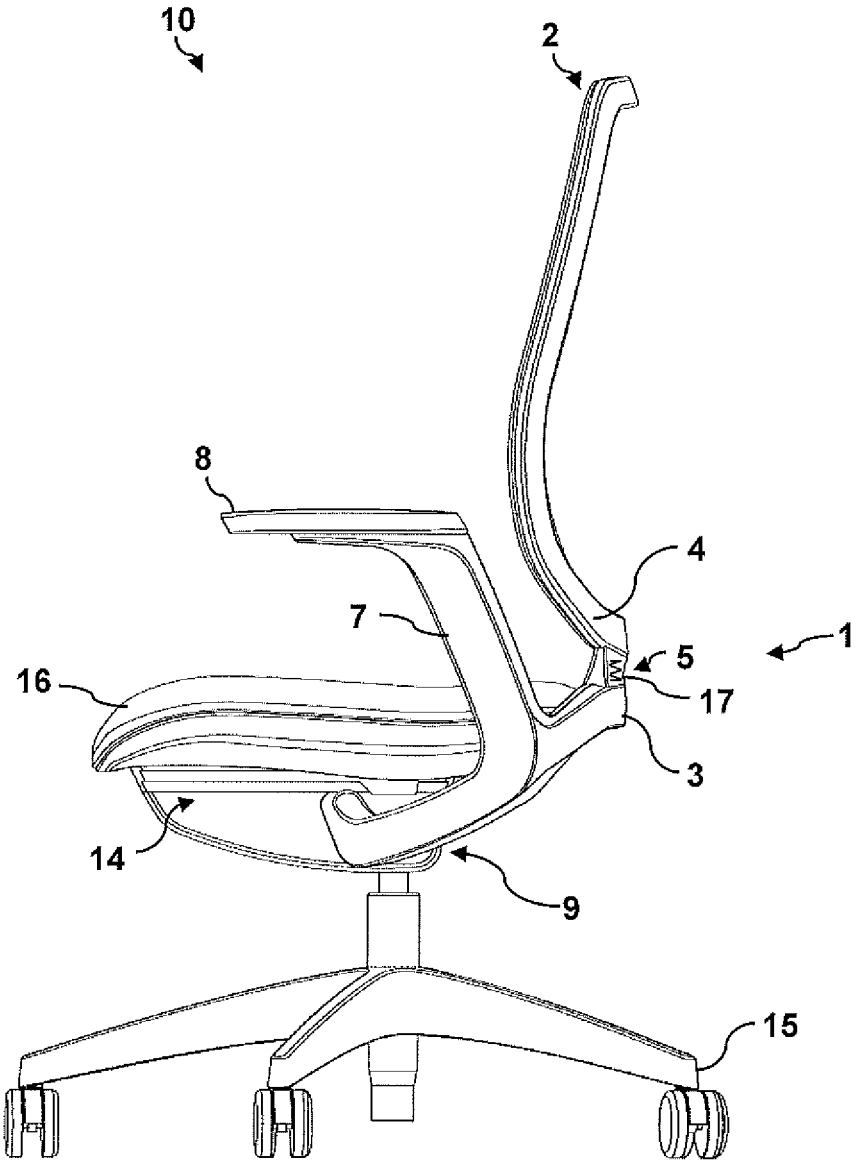
FIG. 3 is a side view of the office chair of FIG. 1.

FIG. 1 is a schematic perspective view of an office chair 10, when viewed obliquely from the rear, including a connection assembly 1 according to an embodiment of the invention. The office chair 10 of FIG. 1 is shown in a rear view in FIG. 2 and shown in a side view in FIG. 3.

The office chair 10 comprises a base 15, a seat support 14, a seating surface 16 as well as a backrest 2.

The office chair differs from a conference chair substantially in the base 15, which, in the present case, is formed as a swivel base having castors. In case of a conference chair, for example, the base may be a swivel base without castors, a cantilever base or another type of base. Therefore, all features described below with reference to an office chair are equally applicable to a conference chair.

Here, the office chair 10 is formed as an office swivel chair and furthermore comprises a connection assembly 1. The connection assembly 1 is formed by a transverse support element 3, a backrest structural element 4 and a connection portion 5. The connection portion 5 connects the transverse support element 3 to the backrest structural element 4 and is formed so that the backrest structural element 4 is resiliently movable relative to the transverse support element 3. On the one hand, here, elasticity can be attained by choosing an elastomeric material for the connection portion 5, such as thermoplastic polyurethane (TPU). On the other hand, the connection portion 5 may have spring elements 17 and/or be made thereof. In principle, these aspects may be combined with each other. In the figures, two spring elements 17 are drawn by way of example.

Further, the office chair 10 is formed by a transverse bearing 6 by means of which the backrest structural element 4 is rotatably coupled to the transverse support element 3 in a direction perpendicular to a transverse direction (i.e., the backrest can be rotated perpendicular to the seating surface 16). The transverse bearing 6 is embedded in the connection portion 5 and therefore, for the sake of clarity, merely schematically marked in the figures by broken lines. The transverse bearing 6 comprises a bearing pin 11 rotatably supported in a lower bearing bush 12 of the transverse support element 3 and in an upper bearing bush 13 of the backrest structural element 4. In principle, it will disclose itself to a person skilled in the art that the bearing pin 11 may also be (fixedly) connected to the transverse support element 3 or the backrest structural element 4 or be molded on one of these two elements.

The seat support 14 is coupled to the transverse support element 3. The backrest structural element 4 further forms a supporting portion of the backrest 2, here a backrest frame, for example. Here, the transverse support element 3 is formed as armrest support, the armrest support being formed in a fork shape having two fork arms 7, each of which respectively forms one armrest 8. Thus, each fork arm 7, i.e. each armrest 8, is connected to the backrest structural element 4 via the connection portion 5. In this embodiment, both the transverse support element 3 and the backrest structural element 4 may be injection-molded parts of plastic. In particular, the transverse support element 3 may thus be integrally molded with the fork arms 7 and the armrests 8, i.e. as a rigid and stiff plastic component.

In this embodiment, the transverse support element 3 is formed as a part of a synchronizing mechanism 9 usually provided in an office chair. To this end, an end of the transverse support element 3 facing away from the fork arms 7 is coupled to the synchronizing mechanism 9 of the seat support 14 or the office chair 10 in a way generally known to a person skilled in the art. However, other embodiments without a synchronizing mechanism are also conceivable, particularly for conference seating furniture. In this case, the transverse support element 3 may be fixedly attached to the seat support 14.

An optimum mobility of the backrest 2 of the office chair 10 is achieved by advantageous combination of resiliently connecting the transverse support element 3 (which functions here as rigid transverse support, i.e. as stiff substructure for connecting the backrest 2) to the backrest structural element 4 and rotatably coupling these two structural elements. A special advantage of the embodiment shown is here the direct coupling of the armrests 8 to the backrest 2 via the connection assembly 1. Hereby, an ergonomically advantageous mobility, preferably a dorsokinetic mobility, of the backrest 2 is provided. This connection of the backrest 2 provides a significant improvement in mobility compared to conventional solutions. In addition, the depicted solution is particularly robust and cost-efficient in production.

In the previous detailed description, various features have been summarized in one or more examples to improve the stringency of representation. However, it should be clear that the above description is merely illustrative, but by no means limiting in nature. It serves to cover all alternatives, modifications and equivalents of the various features and examples of embodiment. In view of the above description, many other examples will immediately and directly be apparent to a person skilled in the art due to his/her professional knowledge.

The examples of embodiment were chosen and described to present the underlying principles of the invention and applicabilities in practice thereof at best. Thereby, persons skilled in the art may optimally modify and use the invention and various embodiment examples thereof with reference to the intended use. In the claims and the description, the terms "including" and "having" are used as neutral terms for the respective terms of "comprising". Moreover, using the terms "a" and "an" is not intended to exclude a plurality of such described features and components as a matter of principle.

LIST OF REFERENCE NUMBERS

1 connection assembly
2 backrest
3 transverse support element
4 backrest structural element
5 connection portion
6 transverse bearing
7 fork arm
8 armrest
9 synchronizing mechanism
10 office or conference chair
11 bearing pin
12 lower bearing bush
13 upper bearing bush
14 seat support

15 base
16 seating surface
17 spring element

The invention claimed is:

1. A connection assembly for a backrest of a chair, comprising:

a backrest structural element, a transverse support element, a transverse bearing configured to rotatably couple the backrest structural element to the transverse support element in a direction perpendicular to a transverse direction, and a connection portion connecting the transverse support element to the backrest structural element and being arranged and configured so that the backrest structural element is resiliently movable relative to the transverse support member, wherein the connection portion is configured and arranged as a return member to reset a rotary movement of the transverse bearing around an axis of rotation by elastic force.

2. The connection assembly according to claim 1, wherein the transverse support element is configured as an armrest support.

3. The connection assembly according to claim 2, wherein the transverse support element is configured in a fork shape having two fork arms, wherein each fork arm respectively comprises one armrest or is configured to receive one armrest.

4. The connection assembly according to claim 1, wherein the backrest structural element is configured as a backrest frame.

5. The connection assembly according to claim 1, wherein the transverse bearing comprises a bearing pin rotatably supported in at least one of a lower bearing bush of the transverse support element and an upper bearing bush of the backrest structural element.

6. The connection assembly according to claim 1, wherein the transverse bearing is embedded in the connection portion.

7. The connection assembly according to claim 1, wherein the connection portion is configured to have resilient properties realized by comprising an elastomeric material.

8. The connection assembly according to claim 7, wherein the connection portion is integrally molded of the elastomeric material.

9. The connection assembly according to claim 1, wherein the connection portion is configured to have resilient properties realized by at least one of thinning of material of the connection portion, material recesses defined in the connection portion and different elastic properties of material of the connection portion at different portions thereof.

10. The connection assembly according to claim 1, wherein the connection portion comprises at least one spring element.

11. The connection assembly according to claim 1, wherein the connection portion comprises a return spring configured and arranged to reset a rotary movement of the transverse bearing around its axis of rotation by elastic force.

12. The connection assembly according to claim 1, wherein the transverse support element is molded of a plastic incorporating a metal reinforcement.

13. The connection assembly according to claim 1, wherein the transverse support element is disposed at a height of at least one of a seat support and a seating surface of the chair.

14. The connection assembly according to claim 1, wherein, in a region of the transverse support element adjacent the connection portion, the transverse support element is bent upwardly towards the backrest structural element or downwardly towards a base of the chair.

15. A chair, comprising:

a backrest and at least two armrests coupled to a seat support, and a connection assembly according claim 1, wherein the seat support is coupled to the transverse support element and the backrest structural element forms a supporting portion of the backrest.

16. The chair according to claim 15, wherein the transverse support element is formed as a part of a synchronizing mechanism of the chair.

* * * * *